US005500100A

United States Patent [19]

Riley et al.

[11] Patent Number: 5,500,100

[45] Date of Patent: Mar. 19, 1996

[54] METHOD FOR REMOVING MAGNESIUM FROM ALUMINUM-MAGNESIUM ALLOYS WITH ENGINEERED SCAVENGER COMPOUND

[75] Inventors: William D. Riley, Albany; Bing W. Jong, Corvallis, both of Oreg.

[73] Assignee: The United States of America as represented by the Secretary of the Interior, Washington, D.C.

[21] Appl. No.: 317,050

[22] Filed: Oct. 3, 1994

[51] Int. Cl.[6] ..... C25C 3/04

[52] U.S. Cl. ..... 205/404

[58] Field of Search ..... 204/69, 68, 70

[56] References Cited

U.S. PATENT DOCUMENTS 4,430,147 2/1984 Tsumura ..... 204/67

*Primary Examiner*—Kathryn Gorgos
*Attorney, Agent, or Firm*—E. Philip Koltos

[57] ABSTRACT

A process of recovering magnesium from an aluminum-magnesium alloy using a two electrode cell, comprising:

placing an engineered scavenger compound in an electrode basket of a two electrode cell;

adjusting the temperature of a surrounding heating furnace to a temperature below at the melting point of an Al—Mg alloy under a salt bath in a crucible disposed in the cell;

immersing the electrode basket containing the engineered scavenger compound into a molten salt bath and making an electrical connection between the crucible and the electrode basket until the engineered scavenger compound is charged with Mg to a point sufficient to cause cessation of voltage and current flow; and making an electrical connection between the basket electrode containing the engineered scavenger compound and Mg and a stainless steel rod electrode disposed within the molten salt bath, and applying a current through a DC voltage sufficient to cause captured Mg to leave the engineered scavenger compound and become electrodeposited on the stainless steel rod.

9 Claims, 1 Drawing Sheet

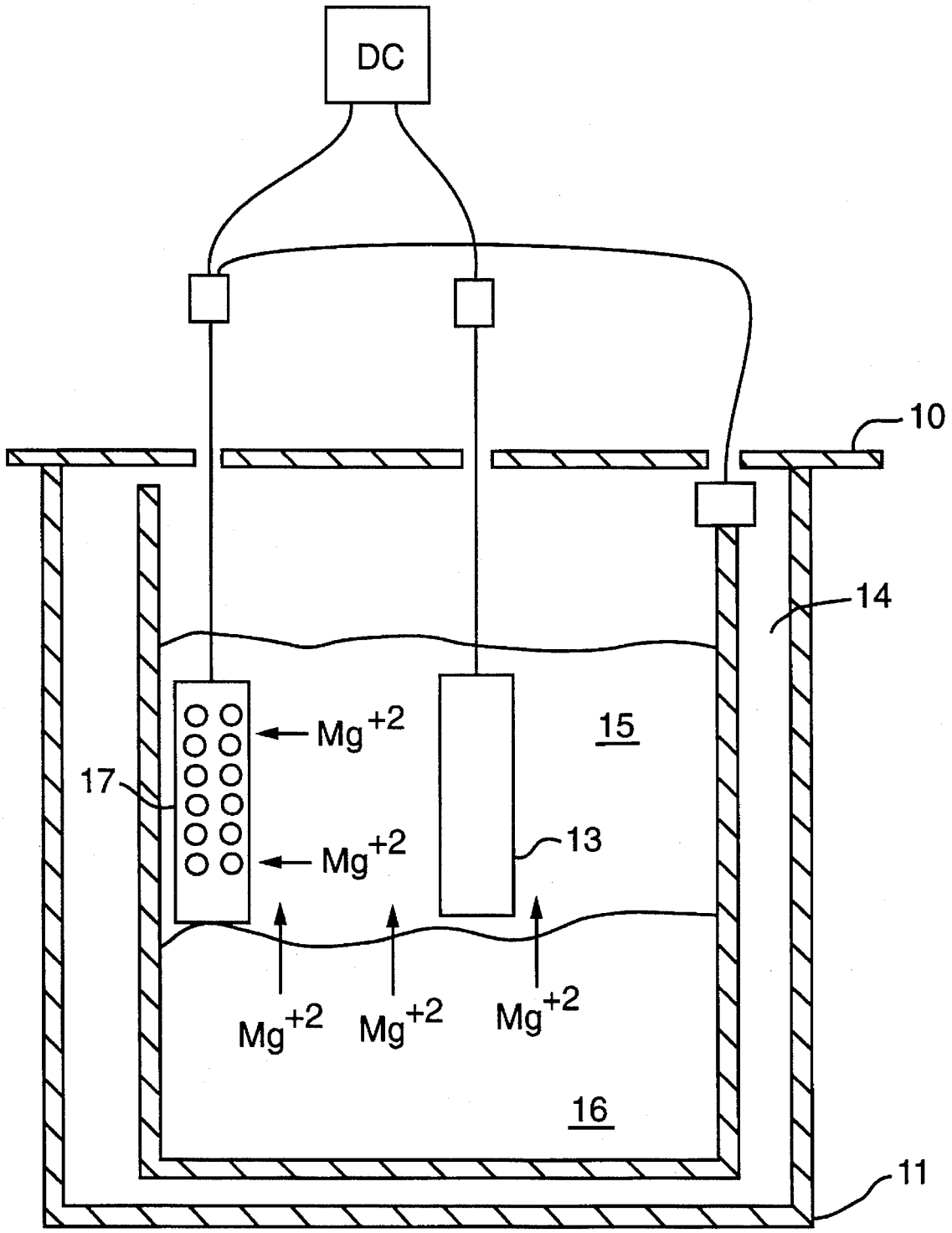
DC
10
14
15
17
13
16
11
$Mg^{+2}$
$Mg^{+2}$
$Mg^{+2}$
$Mg^{+2}$
$Mg^{+2}$

METHOD FOR REMOVING MAGNESIUM FROM ALUMINUM-MAGNESIUM ALLOYS WITH ENGINEERED SCAVENGER COMPOUND

FIELD OF THE INVENTION

The present invention relates to a method for removal and production of high purity magnesium from aluminum-magnesium alloys using an engineered scavenger compound. In particular, the invention relates to a method for removal and production of high purity magnesium from aluminum-magnesium alloys using the engineered scavenger compound (ESC) lithium titanate ($Li_2O.3TiO_2$). The removal of magnesium from the aluminum-magnesium alloys is performed at about 600°–750° C. in a molten salt bath of KCl or KCl—$MgCl_2$ using lithium titanate ($Li_2O.3TiO_2$) as the engineered scavenger compound (ESC). Electrode deposition of magnesium from the loaded ESC onto a stainless steel electrode is accomplished in a second step, and provides a clean magnesium electrode deposit for recycling. The second step also prepares the ESC for reuse.

BACKGROUND OF THE INVENTION

The secondary aluminum cast alloy industry uses mixed feedstock, including, Al—Mg scrap from 2xxx, 5xxx, 6xxx, and 7xxx alloys used in the aerospace, body panel and engine parts industry. It is typically "clean scrap" and is considered premium feedstock for remelting into secondary cast alloys.

These alloys usually contain up to about 3% magnesium and must be "demagged" (so that the magnesium level is reduced to about 0.1 to about 0.6% before use) for use in casting alloys.

Current technology offers essentially four procedures for magnesium removal:

1) oxidation of the magnesium during melting of the scrap;

2) vacuum distillation of the magnesium from the bulk scrap during melting;

3) reaction of the magnesium with chlorine; and 4) displacement of magnesium with iron.

However, economic and practical considerations eliminate procedures 2) and 4) because of requirements for additional processing steps or the need for expensive vacuum equipment.

While the most popular of the current technologies for removing magnesium is by chlorination with gaseous or solid sources of Cl, there is an initiative by the U.S. Environmental Protection Agency to develop and prescribe recovery processes that do not present the environmental and safety concerns of chlorination processes. With this initiative in mind, the ideal approach is to remove and recover the magnesium from the Al—Mg alloy without chlorination using a technology that is inherently safer and has a minimum of processing steps.

SUMMARY OF THE INVENTION

One object of the present invention is to provide a process for removing magnesium in high purity form from aluminum-magnesium alloys using an engineered scavenger compound.

Another object of the invention is to provide a process for removing magnesium in high purity from aluminum-magnesium alloy scraps and to recycle magnesium metal that is selectively recovered.

A further object of the invention is to provide a process for removing magnesium from aluminum-magnesium alloy scraps at approximately 600°–750° C. in a molten bath salt of KCl or KCl—$MgCl_2$ using an engineered scavenger component of lithium titanate ($Li_2O.3TiO_2$).

A still further object of the invention is to provide a process for removing magnesium from aluminum-magnesium alloys in a molten bath salt of KCl or KCl—$MgCl_2$ using lithium titanate as the engineered scavenger compound and to electrodeposit the magnesium from the loaded lithium titanate compound onto a stainless steel rod electrode.

A yet further object of the invention is to provide a process for removing magnesium from aluminum-magnesium alloy scraps in a molten bath salt of KCl or KCl—$MgCl_2$ using lithium titanate, by electrodepositing magnesium from the loaded lithium titanate compound onto a stainless steel rod electrode and using the magnesium so electrode deposited for recycling, after preparing the engineered scavenger compound for reuse.

In general, the process for removing magnesium from aluminum-magnesium alloys is accomplished by using a molten salt bath of KCl or KCl—$MgCl_2$ by adding the Al—Mg alloy to a graphite crucible. Thereafter, the scavenger compound is loaded into a stainless steel electrode basket and the aluminum-magnesium alloy is melted under the bath salt in the crucible. Next, the temperature in the resistance heating furnace is adjusted to the melting point of the alloy. Upon reaching the melting point of the alloy, the basket containing the ESC is immersed into the molten salt above the molten Al alloy and an electrical connection is made between the crucible and the electrode basket. When the reaction is completed, there is a fall off of voltage and current as the scavenger compound is fully charged with magnesium, and the electrical connection is broken.

Upon making an electrical connection between the basket electrode which contains the ESC and the stainless steel rod electrode and applying a current of about 0.2–0.5 Ma at 0.9 V DC, the captured magnesium leaves the scavenger compound and becomes electrodeposited on the stainless rod electrode.

DESCRIPTION OF THE DRAWING

FIG. 1 is a two electrode cell which shows the reaction process for recovering magnesium from an aluminum-magnesium alloy scrap in a molten salt bath using lithium titanate as the engineered scavenger compound.

DETAILED DESCRIPTION OF THE INVENTION

The engineered scavenger compound (ESC) of lithium titanate ($Li_2O.3TiO_2$) is prepared by heating a mixture of $Li_2CO3$ and $TiO_2$ (either anatase or rutile). The preparation of the $Li_2O.3TiO_2$ gives it a unique structure that allows it to accommodate ions of a specific charge and size ($Mg^{+2}$, 1.32 Å).

In the electrochemical cell, the ESC makes up one electrode while the molten Mg-containing aluminum alloy is the other electrode. The molten salt serves both as a wetting agent for the ESC and protects the molten alloy from excessive oxidation.

In one embodiment of the invention, a basket containing Al—Mg alloy solids, turnings, or borings are suspended in a KCl molten salt bath at temperatures of between about 400°–750° C. The ESC is placed in another basket and immersed in the molten salt bath. A third stainless steel electrode is placed or positioned in the bath to recover the electrode deposited Mg metal. Electrical connection is made between the lithium titanate ESC and the alloy, and there is an instantaneous generation of current and voltage (which indicates that the reaction is rapidly taking place). During the reaction, the Mg is rapidly removed from the Al—Mg alloy and taken up by the $Li_2O.3TiO_2$ engineered scavenger compound.

After the Mg is removed from the alloy, a small amount of current (0.2–0.5 μA) is applied to the scavenger compound and the Mg is electrodeposited on a stainless steel rod electrode. The $Li_2O.3TiO_2$ is then ready for another cycle.

In another embodiment of the invention, the Al—Mg alloys are melted in a conductive crucible, i.e., a graphite crucible at approximately 750° C. in a KCl salt bath and an electrode containing the scavenger compound is inserted into the salt bath, whereupon the reaction is allowed to proceed. In this embodiment, the electrical connection is made between the electrode and the crucible, and as the reaction goes to completion, the Mg scavenged by the ESC is electrodeposited as metallic Mg on the stainless steel electrode, whereupon the scavenger compound is ready for use in another scavenging cycle.

A third embodiment of the invention, lends itself to a continuous, two reactor processing system that utilizes the flow of molten Al—Mg alloy and the solid scavenger compound in separate porous ceramic tubes surrounded by the molten salt in the primary reactor. The scavenger compound is then reactivated by electrodepositing the Mg on a removal electrode in a second reactor. The scavenger compound is then ready for reuse in the primary reactor.

In a fourth embodiment of the invention, a cell is constructed of a porous ceramic tube that is insertable into the molten aluminum alloy in a tube that contains the KCl bath and a stainless steel basket for the ESC. In operation, the cell is inserted into the molten aluminum alloy and an electrical connection is made between the ESC and the alloy. A fall off in current and voltage indicates that the Mg has been removed. The ESC is then processed off-line to recover the Mg. This fourth approach lends itself to larger scale operations that may be accomplished in existing chlorination ladles.

In a specifically preferred embodiment, the ESC, $Li_2O.3TiO_2$ is prepared by reacting well-mixed portions of about 74–76 mole percent of $TiO_2$, either anatase or rutile, with about 24–26 mole percent of $Li_2CO_3$ in a two-stage heating process. The first stage is conducted at about 900° C. to dry the salts and to covert the $Li_2CO_3$ to $Li_2O$. In the initial 900° C. heating stage, the materials are remixed and heated at 1100° C. to achieve the final product ($Li_2O.3TiO_2$).

This specifically preferred reaction is best demonstrated by reference to the cell shown in FIG. 1, in which the cell comprises a stainless steel top 10, a stainless steel base 11, a stainless steel basket electrode 12, and a stainless steel rod electrode 13. Electrode holders (not shown) in the top of the cell are insulated with ceramic inserts to prevent short circuits. A graphite holder or crucible 14, disposed inside of the steel base is used to contain the molten salt bath 15 and the molten Al—Mg alloy 16. The $Li_2O.3TiO_2$ scavenger compound is loaded into the 316 stainless steel basket, and the Al—Mg alloy is melted under the salt bath in the crucible. The temperature of the resistance heating furnace (not shown) is adjusted to the melting point of the alloy.

Prior to reaching the melting point of the alloy, the basket electrode containing the ESC is immersed into the molten salt above the molten aluminum-magnesium alloy and an electrical connection is made between the crucible and the electrode basket.

In this example, the Mg level in the 7090 alloy was 2.91% and at the end of the experiment the Mg level had been reduced to 0.3%, and this makes the aluminum alloy suitable feed for cast alloy use. It was observed that the voltage and current fell off as the scavenger compound was charged with Mg, and when the reaction process was complete, the electrical connection was broken.

Thereafter, an electrical connection is made between the basket electrode which contains the ESC and the stainless steel rod electrode and a current of about 0.2–0.5 Ma at 0.9 V DC is applied to cause the captured Mg to leave the scavenger compound and be electrodeposited on the stainless steel rod. The Mg metal deposited on the stainless steel rod had a purity of greater than 99.3%.

After the captured Mg is electrodeposited on the stainless steel rod electrode, the scavenger compound is then ready to remove additional Mg from a fresh charge of Al—Mg alloy.

The limitations and complexities of prior art processes for removing magnesium from aluminum-magnesium alloys is overcome by the invention's use of either lithium titanate or $WO_3$ as an ESC that can readily and selectively remove the Mg as a directly recyclable fraction.

In the invention process, the Mg metal is protected from contamination by slag, etc., because it is locked safely within the scavenger compound until it is electrodeposited. The process of the present invention replaces existing recycling techniques for aluminum-magnesium alloys at lower environmental risks.

Further, the process of the present invention provides more efficient, less costly, and safer methods of recovering high purity Mg from scrap Al—Mg alloys and also allows Al fractions to be recycled in conventional ways.

The clear advantages of the invention are: the use of less energy; a means of providing a direct route for recovery of Mg from Al—Mg alloys; a simpler and safer method for recovery of Mg from traditional slag or vacuum distillation; the production of a high purity magnesium product; and the flexibility to conduct the process on a small or batch scale.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation.

What is claimed is:

1. A process for recovering magnesium from an aluminum-magnesium (Al—Mg) alloy using a multiple electrode cell comprising a crucible containing a molten salt bath disposed therein, an electrode basket, and a stainless steel electrode disposed within said molten salt bath, and a heating furnace surrounding said multiple electrode cell, said process comprising:

a) placing an engineered scavenger compound in said electrode basket;

b) placing said Al—Mg alloy into said crucible under said molten salt bath;

c) adjusting the temperature of said heating furnace to a temperature below or at the melting point of said Al—Mg alloy;

d) immersing said electrode basket containing said engineered scavenger compound into said molten salt bath and making an electrical connection between said crucible and said electrode basket until said engineered scavenger compound is charged with Mg to a point to cause cessation of flow of voltage and current; and e) making an electrical connection between said basket electrode containing said engineered scavenger compound and Mg and said stainless steel rod electrode disposed within said molten salt bath, and applying current, through a DC voltage to cause captured Mg to leave said engineered scavenger compound and become electrodeposited on said stainless steel rod.

2. The process of claim 1, wherein said temperature below said melting point of said Al—Mg alloy is about 400° C.

3. The process of claim 1, wherein said molten salt is selected from the group consisting of KCl and KCl—$MgCl_2$.

4. The process of claim 3, wherein said molten salt is KCl.

5. The process of claim 4, wherein said engineered scavenger compound is selected from the group consisting of $WO_3$ and $Li_2OTiO_2$.

6. The process of claim 5, wherein said applied current is between about 0.2 to about 0.5 ma and said DC voltage is about 0.9.

7. The process of claim 6, wherein said crucible is graphite.

8. The process of claim 7, wherein said electrode basket is stainless steel.

9. The process of claim 8, wherein said Mg electrodeposited on said stainless steel rod has a purity greater than 99.3 percent.

* * * * *